United States Patent [19]

Yokoyama et al.

[11] 4,379,096

[45] Apr. 5, 1983

[54] COMPOUND CARBURETOR

[75] Inventors: Hiroshi Yokoyama; Tokuzi Ishida, both of Hamamatsu; Kunio Kikuchi, Odawara; Kazuaki Zama, Chigasaki, all of Japan

[73] Assignees: Suzuki Motor Co., Ltd., Hamana; Mikuni Kogyo Kabushiki Kaisha, Tokyo, both of Japan

[21] Appl. No.: 324,486

[22] Filed: Nov. 24, 1981

[51] Int. Cl.[3] ..... F02M 11/02

[52] U.S. Cl. ..... 261/23 A; 261/41 D

[58] Field of Search ..... 261/23 A, 41 D

[56] References Cited

U.S. PATENT DOCUMENTS

| | | | |
|---|---|---|---|
| 3,168,077 | 2/1965 | Froede | 261/23 C |
| 3,269,712 | 8/1966 | Sutton | 261/41 D |
| 3,282,261 | 11/1966 | Bartholomew | 261/23 A |
| 3,472,211 | 10/1969 | Meininger | 261/41 D |
| 3,669,420 | 6/1972 | Loudenslager | 261/41 D |
| 3,785,627 | 1/1974 | Tuzson et al. | 261/41 D |
| 3,937,766 | 2/1976 | Garcea et al. | 261/41 D |
| 3,944,634 | 3/1976 | Gerlach | 261/41 D |
| 4,244,333 | 1/1981 | Matsumoto | 261/39 A |

*Primary Examiner*—Tim R. Miles

*Attorney, Agent, or Firm*—Cushman, Darby & Cushman

[57] ABSTRACT

A compound carburetor wherein, in order that, in the course of the transit from the primary side to the secondary side, an air-fuel mixture fed to each cylinder may maintain a uniform air-fuel ratio without causing an air lock and the transit may be made smoothly and definitely, an independent secondary slow-running fuel system is provided for each cylinder and a secondary slow mixture path includes in the course a pipe connected between a carburetor part and manifold part.

7 Claims, 4 Drawing Figures

COMPOUND CARBURETOR

BACKGROUND OF THE DISCLOSURE (a) Field of the Invention

This invention relates to improvements in a compound carburetor to be used for an internal combustion engine of a plurality of cylinders.

(b) Description of the Prior Art

In a compound carburetor to be used for an engine of a plurality of cylinders, a primary air-fuel mixture passes through one throttle valve and is then distributed to respective cylinders, a secondary air-fuel mixture is fed to the respective cylinders through secondary throttle valves arranged for the respective cylinders and a secondary slow-running fuel system for controlling the air-fuel ratio at the beginning of opening of the secondary throttle valves is provided to smooth the transit from the primary side of the secondary side. However, in this type of conventional compound carburetor, generally, there have been defects that, as one secondary slow-running fuel system is distributed to the secondary throttle valves of the respective cylinders, due to the fluctuation of the opening of the secondary throttle valve for each cylinder, the fluctuation of the opening area of the secondary bypass hole, the difference in the length and bend of the secondary slow-running mixture path and the air locking phenomenon in the course of the secondary slow-running mixture path likely to occur at a high temperature which are all difficult to technically solve, the air-fuel ratio of the mixture for each cylinder will fluctuate in the course of the transit from the primary side to the secondary side and the transit will be no longer smooth. Further, generally, the carburetor body is sectioned into a carburetor portion, a manifold portion and a throttle body portion and is formed by combining them. However, the above mentioned secondary slow-running fuel system or particularly the secondary slow-running mixture path is formed within these respective portions, is therefore comparatively long in the total length and can not help having many bends. Not only this will be likely to cause an air locking phenomenon when the engine temperature rises as described above but also it will increase the flow resistance to cause the delay of the transit from the primary side to the secondary side and the unstable jet of the mixture. Therefore, in order to shorten the total length of the secondary slow-running mixture path and to decrease the bends, it has been already attempted to arrange the carburetor portion and throttle body portion in the same plane. However, there have been defects that this arrangement will not only increase the useless thickness of the component parts but also require a large space and cause a leakage due to different strains of the respective portion by heat.

SUMMARY OF THE INVENTION

Therefore, a primary object of the present invention is to provide a compound carburetor for internal combustion engines wherein the transit from the primary side to the secondary side will be smoothly made and the air-fuel ratio of a mixture fed to each cylinder will not fluctuate.

According to the present invention, this object is attained by providing an independent secondary slow-running fuel system for one cylinder or each of two cylinders.

According to a preferred formation of the present invention, the mixture path of the secondary slow-running fuel system includes a pipe airtightly fitted between one part and the other part of the carburetor body. Thereby, the length of the mixture path of the secondary slow-running fuel system can be made shortest and the above described problems can be solved. The pipe is fitted with an O-ring made of an elastic sealing material or has a rib formed at each end and is made preferably of such adiabatic material as a phenol resin.

DESCRIPTION OF THE PREFERRED EMBODIMENTS

Figure 1:
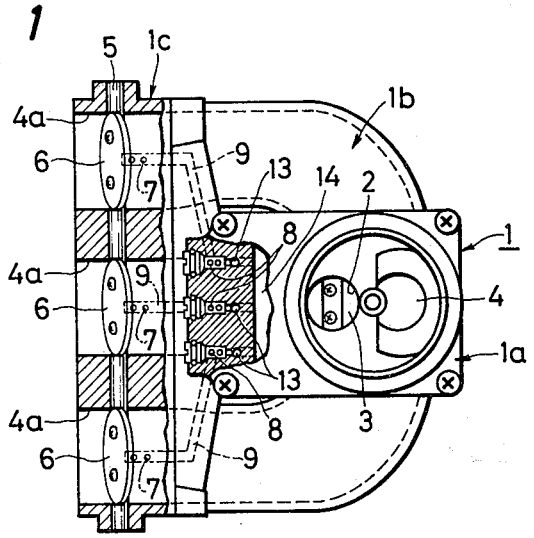
FIG. 1 is a partly sectioned plan view of an embodiment of a compound carburetor according to the present invention.
Figure 2:
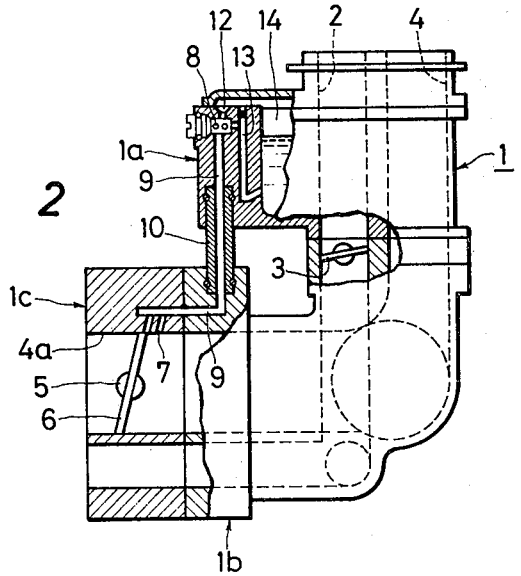
FIG. 2 is a side view of the compound carburetor shown in FIG. 1.
Figure 3:
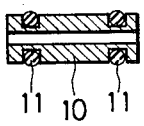
FIG. 3 is a sectional view showing an example of a pipe forming a part of a mixture path of a secondary slow-running fuel system.
Figure 4:
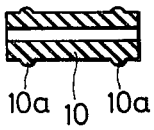
FIG. 4 is a sectional view showing another example of a pipe forming a part of a mixture path of a secondary slow-running fuel system.

With reference to FIGS. 1 and 2, the reference numeral 1 indicates a carburetor body consisting of a carburetor portion 1*a*, manifold portion 1*b* and throttle body portion 1*c*, 2 indicates a primary bore and 3 indicates a primary throttle valve provided on the downstream side of a venturi portion not illustrated. The primary bore 2 is branched on the downstream side of the primary throttle valve 3 and is connected to each cylinder. The reference numeral 4 indicates a secondary bore which is branched on the downstream side of the venturi portion not illustrated and is connected to each cylinder. The reference numeral 5 indicates a secondary throttle shaft passing through each branched path 4*a* of the secondary bore 4 in the direction intersecting at right angles with the center line of the branched path 4*a* and 6 indicates a secondary throttle valve secured to the secondary throttle shaft 5 within each branched path 4*a*. The reference numeral 7 indicates a secondary bypass hole provided in the inner wall of each branched path 4*a* and 8 indicates a secondary slow-running jet connected to each secondary bypass hole 7 through each secondary slow-running mixture path 9. A pipe 10 fitted at one end to the carburetor portion 1*a* and at the other end to the manifold portion 1*b* is set in the course of each secondary slow-running mixture path 9, that is, between the part positioned in the carburetor portion 1*a* of the path 9 and the part positioned in the manifold portion 1*b* so as to make the length of the mixture path 9 shortest. By the way, in connecting such many holes, the pitch and size of the holes will be likely to fluctuate and problems will be likely to arise in the concentricity and sealability. However, in the case of this embodiment, as shown in FIG. 3, O-rings 11 made of an elastic sealing material are fitted on the outer peripheral portions at both ends of the pipe 10 so as to solve such problems. Also, as different from it, as shown in FIG. 4, the pipe 10 itself may be molded of an elastic sealing material to have ribs 10*a* integrally formed on the outer peripheral portions at both ends. Further, if such adiabatic material as a phenol resin is used for the material of the pipe 10, the pipe will be thermally excellent. The reference numeral 12 indicates a secondary slow-running air jet connected to each secondary slow-running jet 8 and 13 indicates a secondary slow-running fuel path connecting each secondary slow-running air jet 12 with a float chamber 14. The part from the secondary bypass hole 7 to the secondary slow-running fuel path 13 forms a secondary slow-running fuel system and each secondary slow-running jet 8 can have its size freely selected.

The operation of the above described compound carburetor shall be explained in the following.

During the operation of the engine, if a pedal not illustrated is trodden down for the acceleration, first the primary throttle valve will open and then the secondary throttle valve will open to gradually feed a large amount of a thick air-fuel mixture to each cylinder. In this case, in the course of the transit from the primary side to the secondary side, at the beginning of opening of the secondary throttle valve 6, each secondary slow-running fuel system will act independently on each cylinder. Therefore, even if the opening of the secondary throttle valve 6 for each cylinder and the opening area of the secondary bypass hole 7 fluctuate and the length and bend of the secondary slow-running mixture path are different, by individually adjusting the size of each secondary slow-running jet 8, the fluctuation of the air-fuel ratio for each cylinder in the course of the above mentioned transit will be able to be reduced. Further, as the secondary slow-running fuel systems for the respective cylinders are independent so as not to interfere with each other, the size of the secondary slow-running jet 8 for each cylinder can be freely selected and, as a result, the air-fuel ratio for each cylinder in the course of the above mentioned transit can be made optimum by taking the thermal factors and vibration conditions into consideration. From the above, according to the compound carburetor of the present invention, the transit from the primary side to the secondary side can be made very smooth. Further, the length of the secondary slow-running mixture path 9 is so short that substantially no air locking phenomenon will be generated by the temperature rise or the like. Therefore, the total volume of the secondary slow-running fuel systems can be made so small and the number of bends of the secondary slow-running mixture path 9 can be made so few that the passage resistance will reduce, the transit delay and unstable jetting of the mixture will be eliminated and, as a result, the response characteristic will improve. Further, as the secondary slow-running mixture path 9 is connected through the pipe 10 in the course, the freedom of the equipment will increase.

In the above mentioned embodiment, the secondary slow-running fuel systems are provided independently for the respective cylinders. However, even if one secondary slow-running fuel system is provided independently for two cylinders so as to serve the two cylinders, the same effect will be able to be obtained. This formation is very advantageous to the cost.

We claim:

1. A compound carburetor comprising a primary bore provided therein with a primary throttle valve and branched in the downstream part of said primary throttle valve to be respectively connected to a plurality of cylinders of an engine to be used, a secondary bore arranged adjacently to said primary bore and branched in the downstream part to be respectively connected to said plurality of cylinders through secondary throttle valves arranged respectively for said plurality of cylinders, and a plurality of secondary slow-running fuel systems set respectively independently for said plurality of cylinders, opened respectively in the vicinity of said respective secondary throttle valves and cooperating respectively with said respective secondary throttle valves.

2. A compound carburetor comprising a primary bore provided therein with a primary throttle valve and branched in the downstream part of said primary throttle valve to be respectively connected to a plurality of cylinders of an engine to be used, a secondary bore arranged adjacently to said primary bore and branched in the downstream part to be respectively connected to said plurality of cylinders through secondary throttle valves arranged respectively for said plurality of cylinders, and a plurality of secondary slow-running fuel systems set respectively independently for a pair of cylinders among said plurality of cylinders, opened respectively in the vicinity of said respective secondary throttle valves and cooperating respectively with said respective secondary throttle valves.

3. A compound carburetor according to claim 1 or 2 wherein said secondary slow-running fuel system comprises a secondary slow-running fuel path, a secondary slow-running jet set in said secondary slow-running fuel path, a secondary slow-running air jet set in connection with said secondary slow-running jet, and a secondary slow-running mixture path communicating with said secondary slow-running jet and secondary slow-running air jet and opened within said cylinder adjacently to said secondary throttle valve.

4. A compound carburetor according to claim 3 wherein said secondary slow-running mixture path includes a pipe airtightly fitted at one end to one part of the carburetor body and at the other end to the other part.

5. A compound carburetor according to claim 4 wherein said pipe includes O-rings made of an elastic sealing material and fitted respectively to both ends.

6. A compound carburetor according to claim 4 wherein said pipe is made of an elastic sealing material and has ribs respectively at both ends.

7. A compound carburetor according to claim 4 wherein said pipe is made of an adiabatic material.

* * * * *